United States Patent [19]

Ford

[11] 4,045,011

[45] Aug. 30, 1977

[54] ARMBOARD

[76] Inventor: John L. Ford, 4651 E. Palomino Road, Phoeniz, Ariz. 85018

[21] Appl. No.: 736,074

[22] Filed: Oct. 27, 1976

[51] Int. Cl.[2] ..... A61G 13/00

[52] U.S. Cl. ..... 269/328

[58] Field of Search ..... 269/322, 327, 328

[56] References Cited

U.S. PATENT DOCUMENTS

| | | | |
|---|---|---|---|
| 2,609,261 | 9/1952 | Parker | 269/327 |
| 2,945,731 | 7/1960 | Tutrone | 269/327 |

FOREIGN PATENT DOCUMENTS

| | | | |
|---|---|---|---|
| 482,548 | 6/1953 | Italy | 269/328 |

*Primary Examiner*—Al Lawrence Smith
*Assistant Examiner*—Robert C. Watson

[57] ABSTRACT

A generally planar support member is detachably securable to a medical table and has an upper surface for receiving the arm of a patient thereon. Brace means depending from the support member abut the table to stabilize the support member in a generally horizontal position. Means are also provided for draining fluids from the upper surface.

4 Claims, 6 Drawing Figures

ARMBOARD

This invention relates to medical and surgical apparatus.

More particularly, the present invention concerns an armboard for supporting the arm of a patient during surgery or medical treatment.

In a further aspect, the instant invention concerns an armboard that is detachably securable to a medical table such as an operating table or stretcher.

Many medical procedures are conducted while the patient is recumbent, either in the prone or supine position, upon a medical table, such as an operating table or stretcher. When the area of concern involves the hand, wrist or arm, the limb is isolated to a position extending from the body. During treatment, which may include examination or surgery, the limb is supported by an auxiliary device.

One common type of arm support is a device that is manufactured integrally with the table. Generally of a narrow slat-like construction, the device is stored in a recess within the table and is slideably moved to a usable position to extend from the side of the table. For use in combination with tables not having an integral arm support, the prior art has provided a separate unit having a similarly shaped arm support member which is free-standing upon a base or legs. When required, the device is simply placed adjacent the table upon which the patient rests.

Prior art arm supports of the type described have certain inherent limitations which have prevented the devices from adequately satisfying the requirements of the medical profession. For example, prior to treatment, especially surgery, the patient's limb is thoroughly cleansed and sterilized. This procedure often requires the use of substantial quantities of liquids, commonly referred to as "prep solutions". Since prior art arm supports are not generally provided with means for disposing of the solutions, nurses or other attendants must resort to soaking up the expanded fluid with towels or other expediencies. Also, since the devices are part of a larger apparatus, either integral with a table or base, the arm support cannot be placed in a sink or other facility for thorough cleansing and sanitizing prior to the use by another patient. Further, in order to provide the physician with close access, arm supports are not generally larger than the limb. This requires that the surgeon utilize additional tray or shelf space for holding the medical instruments, as may be necessary for the surgical procedure.

The position of the arm support which is integral with the table is fixed. That is, the support is not adjustable longitudinally of the table. This requires that the patient be precisely positioned upon the table in order that the limb align with the support. While the separate unit support can be positioned adjacent the table in alignment with a patient's arm, other difficulties are encountered. As the height or position of the table is altered, the arm support apparatus must be repositioned accordingly. It is noted that not all such apparatus are adjustable. The base of such type of apparatus is a source of general inconvenience to the doctor, since he cannot extend his feet or legs under the support member for close access to the patient's limb.

It would be highly desirable therefore to provide an arm support which adequately satisfies the requirements of the medical profession.

Accordingly, it is an object of the present invention to provide an improved armboard for supporting a patient's hand, wrist and arm during treatment or surgery.

Another object of the invention is the provision of a portable armboard which is readily attachable to a conventional prior art medical table, such as an operating table or stretcher.

And another object of the instant invention is to provide an armboard which will not restrict the physician's movements and will provide close access to the patient's limb.

Still another object of the invention is the provision of an armboard having means for draining and disposing of liquids used thereon.

Yet another object of the invention is to provide an armboard which will also support medical instruments in close proximity to the limb for the convenience of the physician.

A further object of the immediate invention is the provision of an armboard which is readily movable from place to place as required and conveniently stored when not in use.

And a further object of the invention is to provide an armboard which is easily cleansed and sanitized.

And still a further object of the instant invention is the provision of an armboard of the above type which is exceedingly durable, yet relatively economical to manufacture.

Briefly, to achieve the desired objects of the present invention in accordance with a preferred embodiment thereof, first provided is a generally planar support member having an upper surface for receiving the arm of a patient thereon. Attachment means extending from the inboard edge of the support member detachably engage the side of the table upon which the patient rests. Brace means depend from the support member and are inclined toward the inboard edge to abut the table for stabilizing the support member in a generally horizontal position.

In a further embodiment, the support member includes an instrument supporting surface adjacent the outboard edge thereof beyond the reach of the patient's limb.

The brace means may further include adjustment means for operatively aligning the support member when moved from table to table.

The foregoing and further and more specific objects and advantages of the present invention will become readily apparent to those skilled in the art from the following detailed description thereof, taken in conjunction with the drawings, in which.

Figure 1:
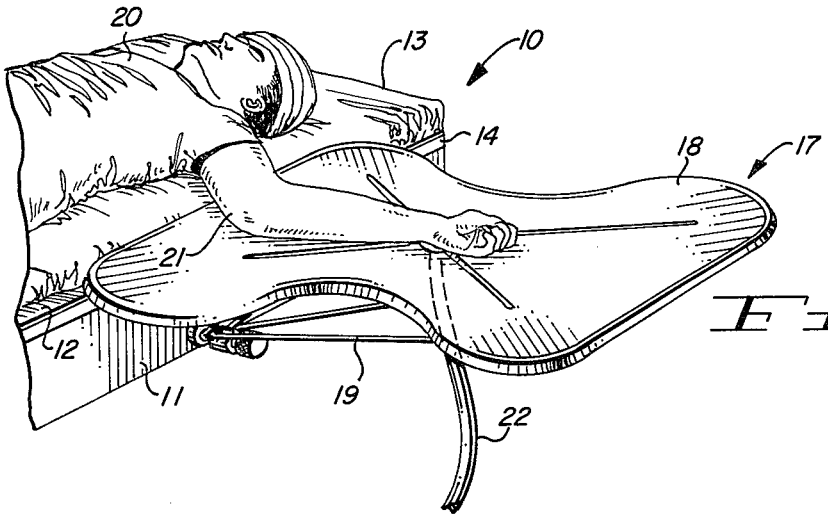
FIG. 1 is a partial perspective view of a medical patient resting on the supine position on a medical table, the patient's arm being extended and supported by an armboard constructed in accordance with the teachings of the present invention, and detachably secured to the medical table.

Turning now to the drawings in which the same reference numerals indicate corresponding elements throughout the several views, attention is first directed to FIG. 1, which shows a medical table generally designated by the reference character 10 and intended to be representative of operating tables, emergency room stretchers, and other similar devices as used in the medical art. Conventionally, medical table 10 includes base frame 11 which supports a platform 12 having a resilient pad 13 thereon. Railing 14 extends along the edge of platform 12. Generally, railing 14 has various receptacles spaced therealong for receiving and holding various medical apparatus.

An armboard, generally designated by the reference character 17 and including support member 18 and brace means 19 is detachably affixed to medical table 10. The body 20 of a medical patient rests upon resilient pad 13 in the normal supine position, with arm 21 extending from body 20 in an isolated position and supported by support member 18. Support member 18 extends generally horizontally from table 10 and has a conduit 22, as might be provided by a length of surgical tubing, depending therefrom to carry away cleansing solutions and other liquids. The various elements, features and utility of armboard 17 will become apparent as the detailed description thereof ensues.

Figure 2:
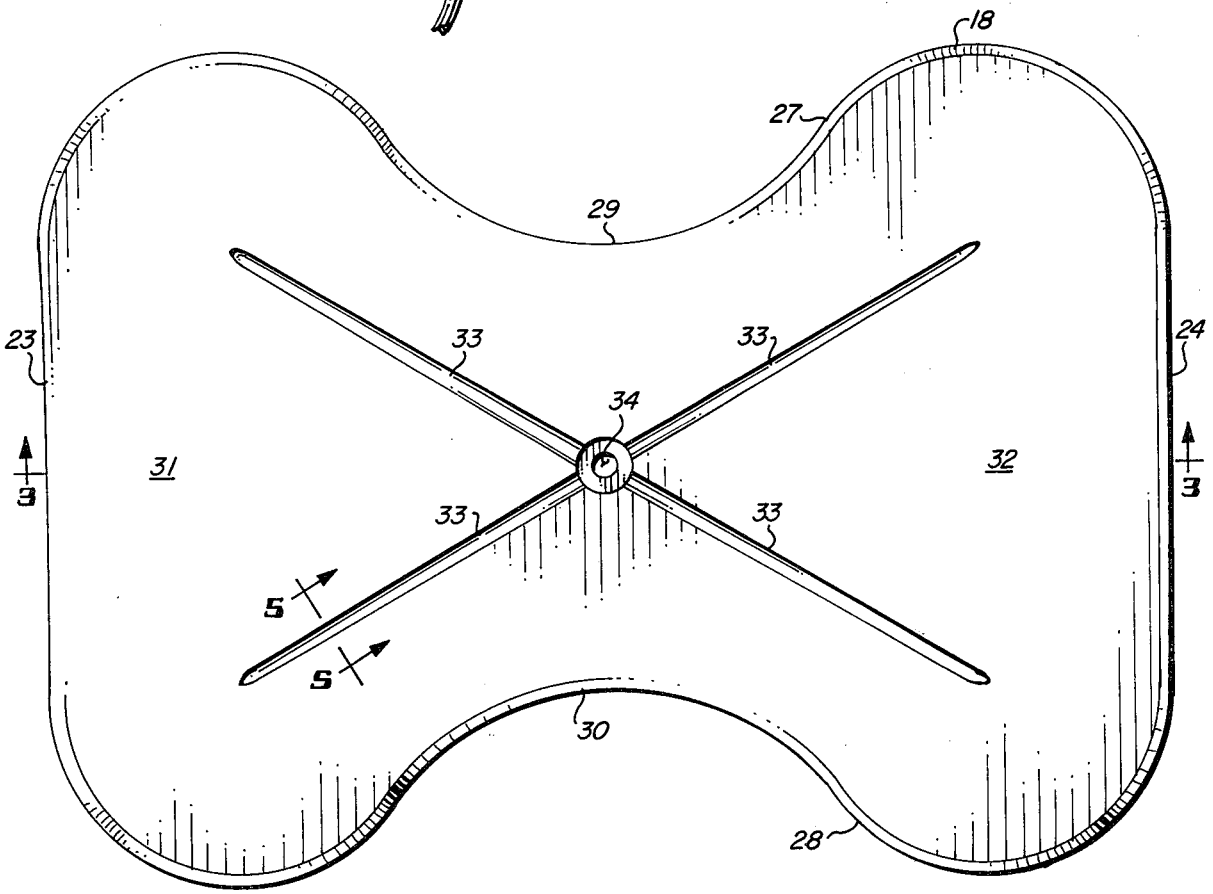
FIG. 2 is a plan view of the armboard of FIG. 1.

As seen in FIG. 2, support member 18 has an inboard edge 23, an outboard edge 24 and longitudinal edges 27 and 28. Longitudinal edges 27 and 28 include recesses 29 and 30 at the approximate mid-sections thereof. Preferably, each recess 29 and 30 is arcuately concave and is sized and shaped to accommodate the frontal portion of the torso of the surgeon or other medical attendant to provide close access to arm 21.

In accordance with a preferred embodiment of the invention, support member 18 is sized to receive the general area of the patient's hand at the approximate mid-point thereof. Support member 18 can be considered to have a first surface area 31 extending from inboard edge 23 to the approximate midpoint, and a second surface area 32 extending from outboard edge 24 to first surface area 31. The primary function of first surface area 31 is to receive and support arm 21. Medical instruments or other paraphernalia, as may be necessary for the immediate treatment or surgery, are readily supported upon second surface area 32 beyond the patient's fingertips and within easy access for the physician or other medical attendant.

Figure 5:
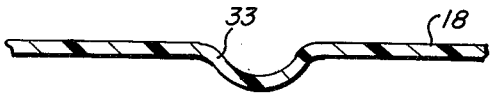
FIG. 5 is a vertical, sectional view taken along the line 5—5 of FIG. 2, and particularly illustrating a fragmentary portion of the armboard having a drainage channel therein.
Figure 6:
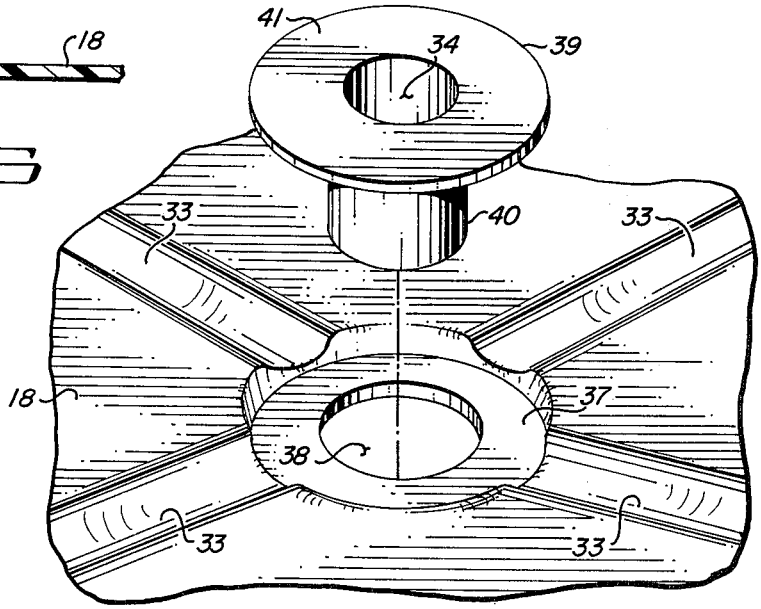
FIG. 6 is an enlarged partial perspective view of the armboard of the present invention, especially showing the drainage means thereof.

Drainage means associated with support member 18 carry away various liquids, such as antiseptics and prep solutions, commonly used in connection with medical treatment and surgery. The drainage means includes fluid conducting channels 33 which lie in the upper surface, comprising first and second surfaces 31 and 32, of support member 18. Channels 33 converge at aperture 34, which is generally centrally located within support member 18. A preferred drainage means is further illustrated in FIGS. 5 and 6. Preferably, support member 18 is fabricated of a relatively thin yet rigid, durable material, as can be provided by molding of fiberglass or stamping of sheet metal, especially stainless steel. Channels 33 are impressed into the upper surface of support member 18 and converge at a common depression 37, having an aperture 38 which extends through support member 18. Drain fixture 39 includes a tubular member 40 which is received through aperture 38 and a radial flange 41 which resides within depression 37. Drain aperture 34 extends through drain fixture 39. Drain member 39 is sealed and secured to support member 18 in accordance with conventional practice in the plastic or metalworking art. Depression 37 is of sufficient depth that fluid within channel 33 will pass over the upper surface of flange 41 and enter aperture 34. The portion of tubular member 40 extending below support member 18 provides a connection means for attaching a conduit. Conventional tubing may simply be slipped over tubular member 40 and secured thereto with a hose clamp, if necessary. Alternately, tubular member 40 may have a threaded end section to receive a threaded coupling carried by conduit 22. Conduit 22 may be of any desired length to conduct the liquid to any suitably convenient receptacle.

Figure 3:
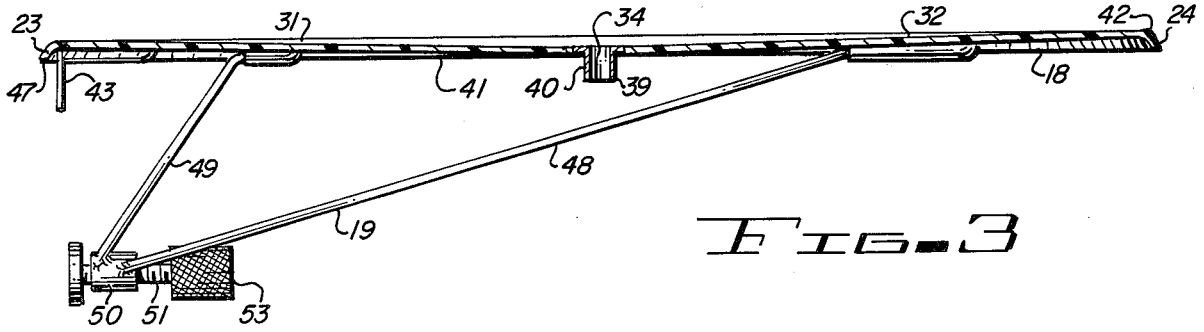
FIG. 3 is a vertical, sectional view taken along the line 3—3 of FIG. 2.

Support member 18 is generally planar. However, as best seen in FIG. 3, support member 18 is slightly and gradually deformed to a low point in the area of drain fixture 39 to insure gravity fluid flow in each channel 33 toward drainage aperture 34. The slight deformation also promotes drainage from the other areas of upper surfaces 31 and 32 toward channels 33. A ridge 42 formed in the opposite manner of channel 33 extends upwardly about the perimeter of support member 18 to prevent liquids from spilling over the edges thereof.

Figure 4:
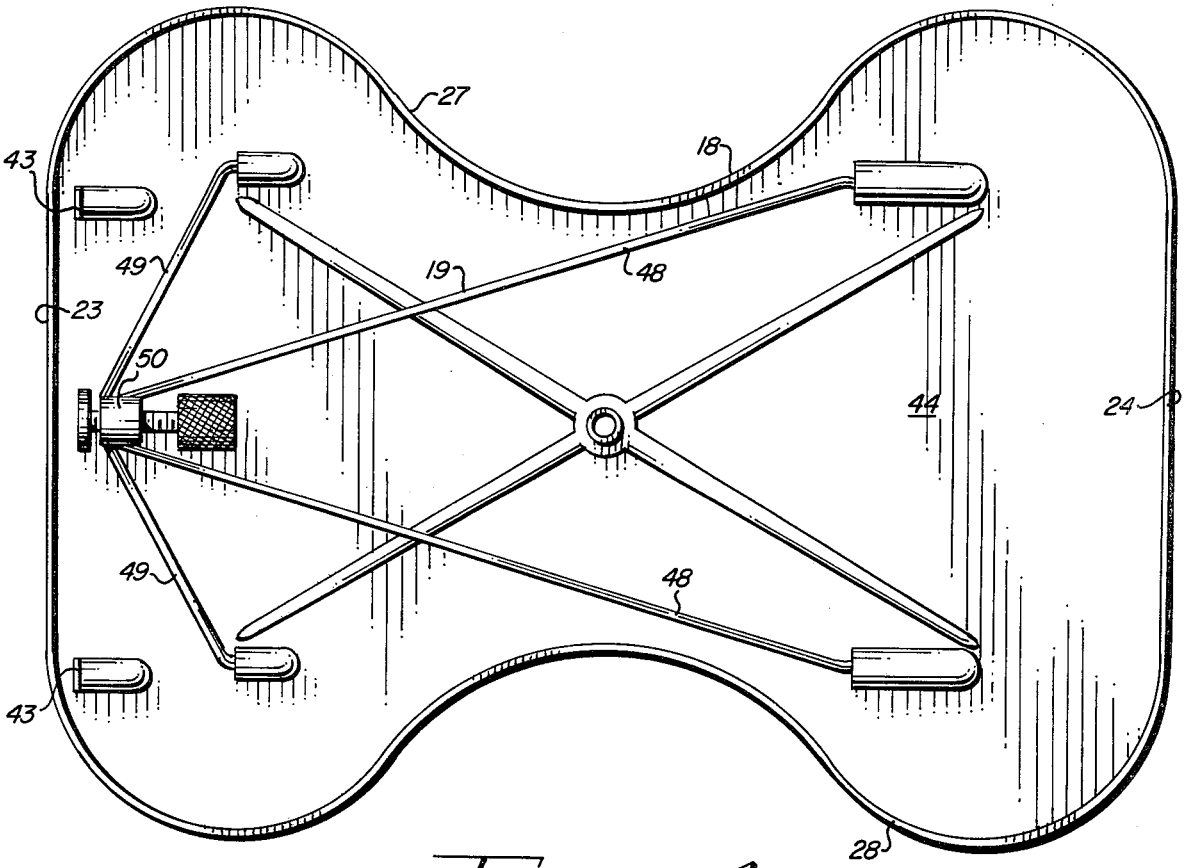
FIG. 4 is a bottom view of the armboard of FIG. 1.

Proximate inboard edge 23 are attachment means for detachably affixing armboard 17 to table 10. Presently preferred attachment means as illustrated in FIGS. 3 and 4 are a pair of spaced projections which depend from the undersurface 44 of support member 18. In accordance with one method of manufacture, each projection 43 is one leg of a L-shaped bracket, the other leg of which is secured to support member 18, in accordance with conventional practice, such as bonding, riveting, or spot welding.

Projections 43 engage over and behind railing 14. To insure that the upper surface of support member 18 lies in substantially the same plane as the upper surface of pad 13, projections 43 are spaced inwardly from inboard edge 23. A lip 47 is thus defined on the undersurface 44 between inboard edge 23 and projections 43. As armboard 17 is assembled with medical table 10, lip 47 is placed over pad 13. Due to the resiliency of pad 13 and the combined weight of armboard 17 and patient's arm 21, lip 47 will settle slightly into pad 13 to bring the upper surface of support member 18 into substantial horizontal alignment with the upper surface of pad 13.

FIGS. 3 and 4 also illustrate brace means 19. A first pair of brace members 48, preferably in the form of stainless steel rods, are secured at one end thereof to undersurface 44 of support member 18. One brace member 48 is attached in the general vicinity of the inner section of outboard edge 24 and longitudinal edge 27, which the other brace member 48 is secured in the region of the inner section of outboard edge 24 and longitudinal edge 28. The pair of brace members 48 are mutually convergent, and, in addition, extend downwardly inward from undersurface 44 toward inboard edge 23. A second pair of brace members 49, also preferably in the form of stainless steel rods, are each attached at one end thereof to undersurface 44. One end of one brace member 49 is attached to undersurface 44 in the general area of longitudinal edge 27 and inboard edge 23, while the other brace member 49 is affixed proximate the inner section of inboard edge 23 and longitudinal edge 28. Similar to first brace members 48, second brace members 49 are mutually convergent and extend downwardly from undersurface 44 and inwardly toward inboard edge 23.

A collar 50, having an internally threaded longitudinal bore extending therethrough, is secured to the free end of each brace member 48 and 49. The threaded bore extending through collar 50 is not herein specifically illustrated, but will be readily appreciated by those skilled in the art. The longitudinal axis of the bore generally aligns, in parallel arrangement, with the imaginary longitudinal axis of support member 18. Externally threaded shaft 51 is matingly received within the threaded bore of collar 50. A radial flange 52 and a knurled knob 53 are carried at the inboard and outboard ends, respectively, of shaft 51. Manual rotation of knob 53 extends and retracts flange 52 relative collar 50. Flange 52 abuts the base of frame 11 and, by rotation of knob 53, the medical attendant is able to quickly make adjustments to bring support member 18 into horizontal alignment with table 10.

It is immediately apparent from the foregoing detailed description of a preferred embodiment that the armboard of the instant invention is readily attached to a medical table when needed. The armboard is conveniently placed at the desired position and quickly adjusted, if necessary, to achieve horizontal alignment. The armboard provides ample working space for the patient's arm and an assortment of medical instruments, yet, due to the recessed longitudinal edges and novel bracing means, the surgeon or medical attendant is afforded close access to the patient's arm. The physician's torso is accommodated and his legs are unobstructed.

It is also appreciated that the armboard of the instant invention is readily removed when no longer needed. Being relatively lightweight and compact, the device is easily transported to proper facilities for cleansing and sterilizing. Due to the relationship between the inboard edge of the support member and the abutting member of the brace means, the device is conveniently stowable in a substantially vertical position upon comparatively little floor or shelf space.

Various changes and modifications in the embodiment herein chosen for purposes of illustration will readily occur to those skilled in the art. For example, various configurations of drainage channels are possible within the functional intent thereof. Alternately, the drainage means may be completely eliminated if not desired. Various configurations of brace means are also anticipated. In addition to modifications of the brace members, alternate adjusting means are envisioned utilizing a solderably mounted member within collar 50 which member may be locked with a conventional thumb-type set screw. For use in connection with standardized table, the adjustment means can be disposed of.

To the extent that such modifications and variations do not depart from the spirit and scope of the instant invention, they are intended to be included herein, and the instant invention assessed only by a fair interpretation of the appended claims.

Having fully described and disclosed the instant invention and a preferred embodiment thereof, in such clear and concise terms as to enable those skilled in the art to understand and practice the same, the invention claimed is:

1. An armboard for detachable securement to a medical table and for supporting the arm of a patient during medical or surgical procedures, said armboard comprising:

a. a generally planar support member having an inboard edge and an outboard edge, and having an upper surface for receiving an arm thereon;

b. attachment means carried proximate the inboard edge of said support member for detachably affixing said armboard to said table; and c. brace means carried by and depending from said support member and inclined toward said inboard edge and having a free end for abutting said table and for stabilizing said support member in a generally horizontal position.

2. The armboard of claim 1, further including adjustment means carried by said brace means for operatively adjusting the slope of said support member, said adjustment means comprising:

a. a first member carried proximate the free end of said brace means and having a substantially horizontal bore extending therethrough; and b. an elongate second member having one end for abutting said table and extensively and retractively movable with the bore of said first member.

3. The armboard of claim 2, further including:

a. an internal spiral screw flight carried within the bore of said first member; and b. an external spiral screw flight carried by said second member and matingly received within said internal spiral screw flight.

4. The armboard of claim 1, further including:

means defining at least one fluid conducting channel impressed into the upper surface of said support member; and b. a drain carried by said support member and communicating with said channel for relief of fluids from said support member.

* * * * *